United States Patent [19]

Hauer et al.

[11] Patent Number: 4,594,026

[45] Date of Patent: Jun. 10, 1986

[54] WEDGE MEMBER FOR ASSEMBLING TUNNEL SHIELD VOUSSOIRS

[75] Inventors: Jean-Claude Hauer, Saulxures Les Nancy; Jacques Oger, Pont-A-Mousson, both of France

[73] Assignee: Pont-A-Mousson S.A., Nancy, France

[21] Appl. No.: 613,983

[22] Filed: May 25, 1984

[30] Foreign Application Priority Data

May 27, 1983 [FR] France ..... 83 08860

[51] Int. Cl.[4] ..... E21D 11/22

[52] U.S. Cl. ..... 405/153; 52/81; 52/584; 405/151; 403/408.1

[58] Field of Search ..... 405/153; 52/81, 82, 52/86, 245, 578, 580, 581; 403/90, 408

[56] References Cited

U.S. PATENT DOCUMENTS

| | | | |
|---|---|---|---|
| 1,043,034 | 10/1912 | Schlachter | 52/82 |
| 1,307,973 | 6/1919 | Hester | 52/584 X |
| 2,869,182 | 1/1959 | White | 52/86 X |
| 3,006,670 | 10/1961 | Schmidt | 52/81 X |
| 4,318,637 | 3/1982 | Oger et al. | 405/153 |
| 4,441,592 | 4/1984 | Everett | 403/408 X |

*Primary Examiner*—Dennis L. Taylor

*Attorney, Agent, or Firm*—Sughrue, Mion, Zinn, Macpeak and Seas

[57] ABSTRACT

Two adjoining voussoirs 1, 2 in a tunnel shield are assembled by sandwiching a wedge 12 between their adjacent sides 7, 8. The wedge extends over the entire length and width of the voussoir sides, and has concave surfaces 12*a* of equal curvature radius to the convex surfaces of the voussoir sides. The angle $\alpha$ between the adjacent outer surfaces of the voussoirs may be adjusted by varying the radial disposition of the wedge before tightening the assembly. The full mating contact between the voussoir sides and the wedge evenly distributes the applied stress.

6 Claims, 6 Drawing Figures

WEDGE MEMBER FOR ASSEMBLING TUNNEL SHIELD VOUSSOIRS

BACKGROUND OF THE INVENTION

This invention relates to an assembly wedge for two adjoining voussoirs in a tunnel shield for a railroad or the like.

Commonly assigned U.S. Pat. No. 4,318,637 describes a device for the assembly of tunnel shield voussoirs comprised of cylinder segments whose facing sides bear a certain curvature. This device includes two pairs of wedges each arranged at an end of the voussoirs in corresponding housings, and radially connected by bolts which bring the wedges together while tightening them to contact the adjoining sides of the voussoirs. These wedges or pins are satisfactory, but it is sometimes difficult to obtain the exact angle desired between the two voussoirs, i.e. the angle between the planes tangent to their curved external or extrados surfaces at their interface. To do this the two wedges must be separately and simultaneously positioned in the radial direction at the desired location, taking into account the angle sought between the voussoirs. Moreover, the strain sustained by the voussoirs is concentrated on the wedges, which can lead to their plasticization or deformation due to crushing.

French Pat. No. 73/29,114 discloses a voussoir assembly system comprising a series of prismatic wedges selected in a range of dihedral angles adapted to the desired angle, following which the voussoirs are assembled with the wedges superimposed between them and fastened by bolts and nuts. This assembly device requires the use of a wide assortment of wedges.

SUMMARY OF THE INVENTION

The purpose of the invention is to provide a voussoir assembly device which avoids these disadvantages by including a single wedge or shim member extending over the entire length of the facing sides of the voussoirs. The opposite surfaces of the wedge member bear curvatures conjugate with those of the corresponding sides of the voussoirs, and means are provided to attach the voussoirs together with the wedge sandwiched between their sides.

The use of a single wedge rather than several intersecting wedges or several superimposed prismatic wedges appreciably facilitates the control of the angle between the voussoirs. Effectively, it suffices to move the wedge slightly to obtain the exact angle desired, a procedure which presents no difficulties.

When the voussoir sides are convex, the surfaces of the wedge bear concavities whose curvature radii are equal to those of the associated voussoir sides, and the width of the wedge is virtually equal to that of the sides. The angle between the extrados surfaces of the voussoirs perpendicular to their interface can thus be adjusted by the radial movement of the wedge between the sides of the voussoirs before the final fastening or tightening. Moreover, the utilization of a single wedge distributes stress throughout the entire length of the wedge so that no plasticization is noted in the stress area.

DETAILED DESCRIPTION OF THE PREFERRED EMBODIMENT

Figure 1:
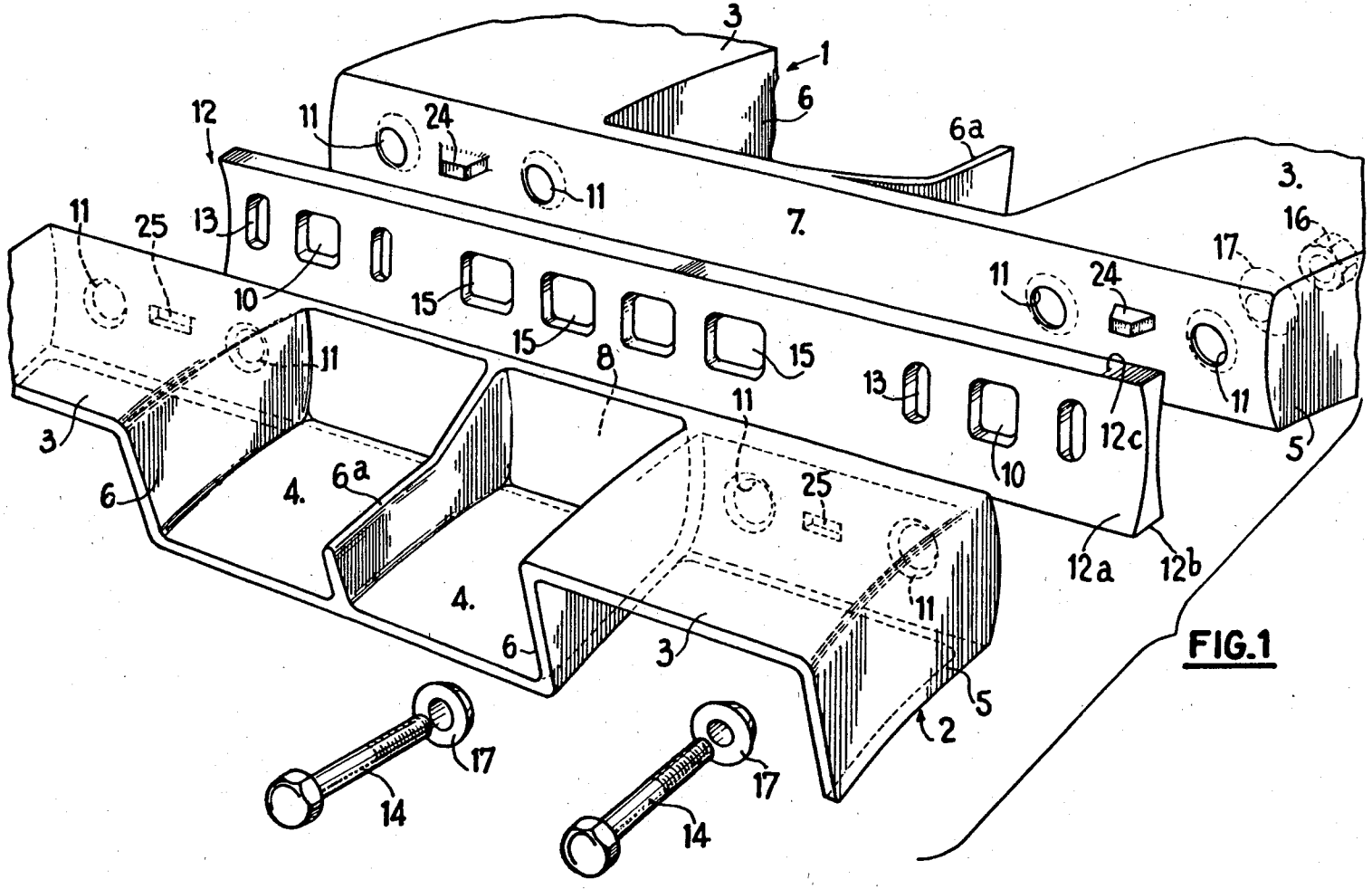
FIG. 1 is an enlarged perspective view of two adjoining voussoirs and a wedge according to the invention positioned for assembly.
Figure 2:
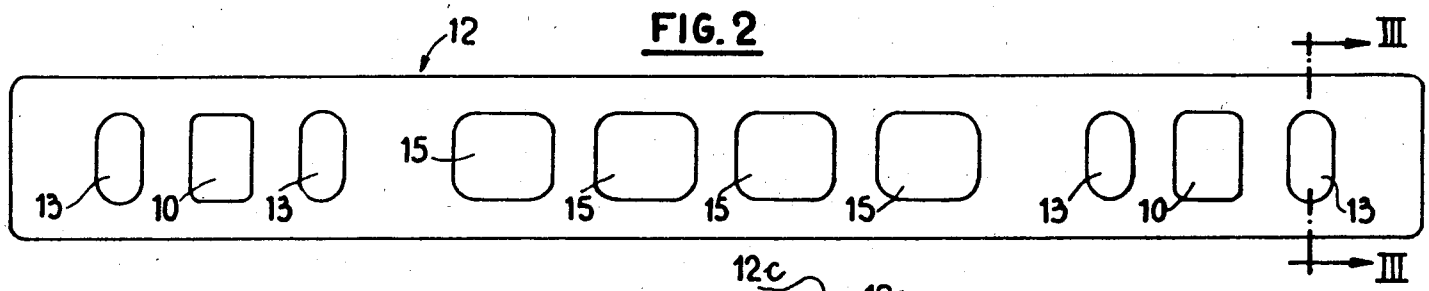
FIG. 2 is a longitudinal flat view of the wedge shown in FIG. 1.
Figure 3:
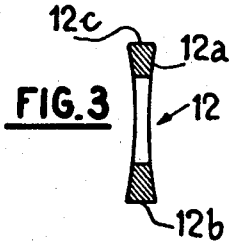
FIG. 3 is a cross-section of the wedge on line III—III in FIG. 2.

In FIG. 1 two adjoining voussoirs 1, 2 are shown, intended for the construction of a railroad tunnel shield. The voussoirs comprise cylinder segments made of cast iron or another suitable material, each bearing outer covers 3 forming the extrados surface of the shield, an intermediate cover 4 forming the intrados surface of the shield, end covers 5 and radial ribs 6, 6*a*. The ribs 6 join the covers 3, 4, and rib 6*a* projects radially therebetween.

Each voussoir has a convex side 7, 8 of appropriate curvature radius facing each other. Near the ends of the sides there are two pair of holes 11 for bolts 14 attached to nuts 16.

In accordance with the invention, the voussoirs 1, 2 are assembled by a wedge or shim 12 extending over the entire length and width of the sides 7, 8. The opposite surfaces 12*a* of the wedge are concave and mate with the convex voussoir sides. The curvature radii of these concave surfaces 12*a* are equal to those of the convex sides 7, 8.

At each of its ends, facing the holes 11 in the voussoirs, the wedge 12 has a pair of oblong openings 13 to accommodate the bolts. Openings 10 are provided in the end areas of the wedge between the openings 13, as well as openings 15 in the central area of the wedge to render it lighter.

During assembly the voussoirs are first positioned with their sides 7 and 8 facing each other so that lugs 24 of the voussoir 1 are opposite corresponding housings 25 of the voussoir 2. The wedge 12 is then introduced between the voussoirs with the openings 10 opposite the lugs 24, the bolts 14 are installed through the holes 11 and the openings 13, and the nuts 16 are screwed on but not tightened. The angle $\alpha$ between the planes tangent to the respective extrados covers 3 of the voussoirs, perpendicular to their interface formed by the sides 7, 8, depends on the radial position of the wedge 12 between the voussoirs.

Figure 4:
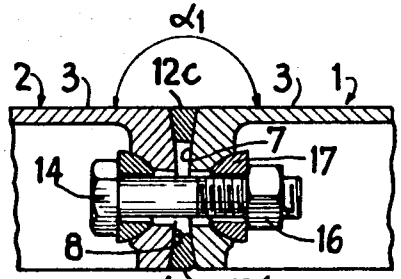
FIG. 4 is a partial transverse section of two assembled voussoirs and the wedge, with the angle between the planes tangent to the respective extrados surfaces of the voussoirs perpendicular to their interface being equal to 180°.

FIG. 4 illustrates a first angular arrangement of the voussoirs in which the angle $\alpha 1$ equals 180°. To urge the voussoirs into this position, the wedge is lightly struck on its bottom edge 12*b* until both this and its upper edge 12*c* are coplanar with the covers 4, 3. The radial elongation of the openings 10 and 13 allows the radial movement of the wedge. The nuts 16 are then tightened against washers 17 to complete the assembly.

Figure 5:
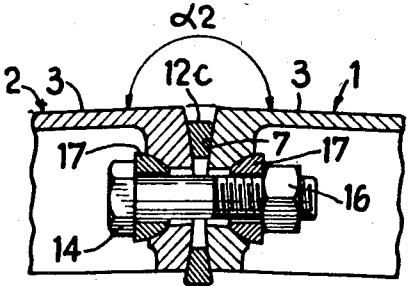
FIG. 5 is a view corresponding to FIG. 4, in which the wedge is positioned radially such that the aforementioned assembly angle is 180°.
Figure 6:
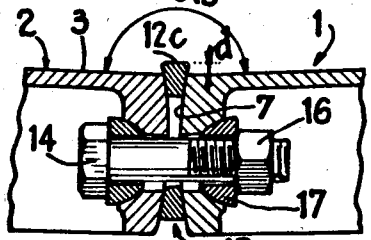
FIG. 6 is a view corresponding to FIGS. 4 and 5 in which the assembly angle is less than 180°.

The angle $\alpha 1$ can be adjusted slightly to either side of 180°, as illustrated in FIGS. 5 and 6. In FIG. 5 the angle $\alpha 2$ of 184° is obtained by radially tapping the wedge 12 toward the intrados surface of the shield until the planes tangent to the covers 3 at the interface form the desired angle. This procedure requires first loosening the nuts 16 if beginning from the position of the voussoirs shown in FIG. 4.

Conversely, in the FIG. 6 position the angle $\alpha 3$ is reduced to 176° by advancing the wedge outwardly a distance d from its position in FIG. 4.

The minimum and maximum values of the angle $\alpha$ are primarily determined by the radial elongations of the openings 10, 13.

As indicated above, the assembly device composed of a single wedge 12 and its fastening components 14, 16 has the advantage of allowing quick and easy control of the angular position of the voussoirs. Effectively, it suffices to place the wedge in the proper position with respect to the sides 7, 8 while exerting adequate pressure on one of the edges 12*b*, 12*c*, and then completely tightening the nuts 16. Preferably the wedge is initially installed in the FIG. 5 position, and then forced radially outwardly to the desired extent by lightly striking its lower edge 12*b*.

Another advantage of this single wedge is that it distributes almost uniformly along its full length the stress sustained by the voussoirs, which substantially prevents the plasticization of the wedge and the voussoirs in the stress area. Effectively, as the stress is distributed over virtually the entire surface of the wedge, a great "flexibility" results in the connection between the voussoirs and the wedge. This connection can even be considered "elastic"; tests having shown that after the application of significant stress, the voussoirs recover their initial form. The tightening of the bolts 14 greatly influences this flexibility; the looser the tightening the better the recovery from sustained stress.

The stress mentioned above is in practice inflexion stress due to the weight of the ground and compression from the vault effect between the adjoining voussoirs. The initial form of the voussoirs is, more precisely, that which is obtained at the time of assembly. Thus, when using the voussoirs to reinforce a tunnel having a radius smaller than that of the ring formed by the voussoirs, the application of stress results in the opening of the angle $\alpha$ initially predicted; if the stress ceases the angle returns to its initial value.

What is claimed is:

1. A device for assembling two adjoining earth supporting voussoirs (1, 2) of a tunnel shield for a railroad or the like, the voussoirs comprising cylinder segments whose facing sides (7, 8) each have a defined curvature, said device comprising:

a solid, elongate, wedge shaped shim member (12) having a length substantially equal to that of the voussoir sides, and opposite faces (12*a*) of the shim member having curvatures complementary to those of the voussoir sides, said shim member being sandwiched between the facing voussoir sides and matingly engaged therewith during assembly to enable the adjustment of the angle ($\alpha$) between planes tangent to the outer surfaces (3) of the voussoirs at their interface by the radial positioning of the shim member.

2. A device according to claim 1, wherein the facing sides of the voussoirs and the opposite faces of the shim member have the same radius of curvature, the voussoir sides being convex and the shim member faces being concave, and the width of the shim member being substantially the same as that of the voussoir sides.

3. A device according to claim 2, wherein the voussoir sides are provided with a plurality of alignably positioned holes (11) to accommodate fastening bolts (14), and the shim member is provided with correspondingly positioned openings (13) for said bolts, said shim member openings being radially elongate to enable the radial adjustment of the shim member position between the voussoirs.

4. An earth supporting voussoir assembly for a tunnel shield, comprising:

(a) a pair of adjoining voussoirs (1, 2) in the form of cylinder segments and having curved facing sides (7, 8) each having a same radius of curvature, (b) a solid, elongate, wedge shaped shim member (12) having a length substantially equal to that of the voussoir sides, and opposite faces (12*a*) of the shim member having equal curvatures complementary to that of the voussoir sides, said shim member being sandwiched between the facing voussoir sides and matingly engaged therewith to enable the adjustment of the angle ($\alpha$) between planes tangent to the outer surfaces (3) of the voussoirs at their interface by the radial positioning of the shim member, and (c) means (14, 16, 17) for fastening the voussoirs and the interposed shim member together.

5. An assembly according to claim 4, wherein the voussoir sides are convex and the shim member faces are concave, and the width of the shim member is substantially the same as that of the voussoir sides.

6. An assembly according to claim 5, wherein the voussoir sides are provided with a plurality of alignably positioned holes (11) to accommodate bolts (14) comprising the fastening means, and the shim member is provided with correspondingly positioned openings (13) for said bolts, said shim member openings being radially elongate to enable the radial adjustment of the shim member position between the voussoirs.

* * * * *